US007740220B2

(12) United States Patent
Jeanveau

(10) Patent No.: US 7,740,220 B2
(45) Date of Patent: Jun. 22, 2010

(54) TWO-PART POLE BRACKET

(76) Inventor: Florent Jeanveau, RR #3, Suite 39, Box 5, Sudbury, Ontario (CA) P3E 4N1

( * ) Notice: Subject to any disclaimer, the term of this patent is extended or adjusted under 35 U.S.C. 154(b) by 18 days.

(21) Appl. No.: 12/170,654

(22) Filed: Jul. 10, 2008

(65) Prior Publication Data

US 2009/0314910 A1 Dec. 24, 2009

(30) Foreign Application Priority Data

Jun. 18, 2008 (CA) ..... 2635325

(51) Int. Cl.
*A01K 97/10* (2006.01)

(52) U.S. Cl. ..... 248/534

(58) Field of Classification Search ..... 248/511, 248/514, 519, 534, 535, 536, 538, 515; 43/21.2; 40/601, 607.9
See application file for complete search history.

(56) References Cited

U.S. PATENT DOCUMENTS

| | | | | |
|---|---|---|---|---|
| 2,905,414 | A * | 9/1959 | Zierden | 47/40.5 |
| 3,273,846 | A * | 9/1966 | De Mare | 248/231.71 |
| D208,365 | S | 8/1967 | Federighi | |
| D217,116 | S | 4/1970 | Pieper | |
| 4,296,524 | A | 10/1981 | Horholt et al. | |
| D286,743 | S | 11/1986 | Cohen | |
| 6,170,877 | B1 | 1/2001 | Zurn | |
| 6,419,200 | B1 * | 7/2002 | Tuneld et al. | 248/514 |
| D495,241 | S | 8/2004 | Ramirez et al. | |
| 7,195,222 | B2 * | 3/2007 | Dent | 248/511 |
| D546,172 | S | 7/2007 | Jeanveau | |
| 2004/0108439 | A1 * | 6/2004 | Ma | 248/519 |
| 2007/0210235 | A1 * | 9/2007 | Hood | 248/519 |

* cited by examiner

*Primary Examiner*—Ramon O Ramirez
(74) *Attorney, Agent, or Firm*—Fay Sharpe LLP

(57) ABSTRACT

There is disclosed a two-part bracket for holding a pole. The two-part pole bracket has a first part, for holding the pole, and a second part, including a cylindrical hollow sleeve, for attaching to a support surface. The first part has an elongate body with a tubular upper section and a tubular lower section. The cylindrical hollow sleeve of the second part is sized and shaped to receive at least a portion of the tubular lower section of the first part. A disengageable rotational interlocking means located between the first part and the second part prevents a rotation therebetween when the first and the second parts are rotationally interlocked. The bracket may be used to hold a light pole, flag pole, umbrella pole, or the like at an angle relative to vertical.

53 Claims, 9 Drawing Sheets

TWO-PART POLE BRACKET

FIELD OF THE INVENTION

The present invention relates generally to pole holders. More particularly, the present invention relates to devices used to hold poles upright.

BACKGROUND OF THE INVENTION

In general, many kinds of devices are known for holding poles upright. For example, U.S. Pat. No. 5,588,630 to Chen-Choa discloses an adjustable base to hold flag banners. The Chen-Choa device has a base for attachment to a surface and a cylinder for holding a pole. The base and cylinder are coupled with a meshing means to permit adjustment of the cylinder relative to the base about a single fixed horizontal pivot axis. U.S. Pat. No. 923,596 to Staples discloses an adjustable shade and umbrella holder also with a single fixed horizontal pivot axis. Like the Chen-Choa device the Staples device permits adjustment of the pole holder relative to the base by a certain angular degree, but only on one plane. U.S. Pat. No. 5,431,364 to Etter discloses a golf umbrella holder which is functionally similar to the Staples device. None of the above mentioned devices permit rotation of the pole holder about any axis other than the pivot axis.

U.S. Pat. Nos. 122,370 and 5,836,327 to Doolittle and Davis respectively, disclose examples of umbrella holders which permit rotation of the pole holder about a vertical axis. However, these pole holders are complex, comprising several parts, and are therefore expensive to manufacture, awkward to use and can loosen unexpectedly causing pole collapse.

U.S. Pat. No. 3,161,390 to Larson, and U.S. Pat. No. 3,063,668 to Yohe, respectively, disclose outrigger pole brackets for fishing boats. These devices are also complex, comprising several parts, which are expensive to manufacture. Moreover, the Larson and Yohe devices are specifically designed for holding outrigger poles, including special features and parts to resist the pole from being pulled out of the pole bracket by a fish on the line, for example, and thus they are more complex, expensive, and difficult to use than is required for a pole support.

U.S. Pat. Nos. 4,827,654 and 6,302,367 to Roberts and Ratza, respectively, disclose fishing rod holders, which are also complex, comprising several parts, which are expensive to manufacture. Moreover, the Roberts and Ratza devices are inappropriate for use in applications other than holding fishing rods, due to their specific features and designs.

What is desired, therefore, is a simple device which is easy to use, less costly to make and yet offers reliable and adjustable support to position a pole, like an umbrella pole, for example, in a preferred position on a base.

SUMMARY OF THE INVENTION

The present invention is directed to a bracket assembly having a simple and inexpensive construction which may be used to attach a pole to a support surface. The bracket assembly may be used to hold an umbrella pole, a light pole, a flag pole, or the like. The bracket assembly has two parts which fit together to form the bracket assembly. The first part is an elongate body which is mostly tubular. The first part has an upper section configured to releasably hold an end of the pole and a lower section configured to be received by a cylindrical sleeve in the second part in a wobble-free manner. The second part includes a cylindrical sleeve and is configured to attach to the support surface by an attachment flange. The bracket may be attached to a support surface on a boat, a dock, a deck, a land vehicle, a building, or a natural or man-made projection from the ground. By way of example, when attached to a boat, the bracket in combination with an umbrella can be used while fishing. When attached to a tree or tree stump, the bracket in combination with a camouflaged umbrella or other canopy can be used while hunting.

The first part is rotatable within the cylindrical sleeve of the second part, so that the orientation of the pole relative to the bracket can be altered. Most preferably, the present invention provides a rotational interlock at a selected position with a disengageable rotational interlocking means located between the first and second parts. Preferably the engagement of the rotational interlocking means is maintained by a weight of the first part and/or a weight of the pole, but may be easily disengaged and adjusted to a new position by a user.

According to a further aspect, the first part is provided with a bend located between the upper section and the lower section to permit the pole bracket to hold the pole at an angle relative to the vertical. When such a configuration is used with a sun umbrella, for example, the user is able selectively rotate the pole to constantly keep the umbrella facing the sun to provide optimal shading as the sun moves through the sky during the day.

The upper section of the first part may be configured to accommodate poles of various diameters within a predetermined range. Preferably the upper section of the first part of the pole bracket also includes a stop means with a gradually narrowing portion (i.e. concave or conical portion) in an interior portion of the upper section to help prevent the pole from wobbling within the upper section.

The simple two part construction of the pole bracket permits a user to easily secure the pole to, and remove it from, the upper section, even when long poles and/or poles attached to bulky or heavy articles are used. Moreover, the two part construction permits the user to easily assemble the bracket by simply inserting a cylindrical lower section of the first part into a cylindrical hollow sleeve in the second part.

Therefore, in accordance with one aspect of the present invention, there is provided a two part bracket for holding a pole, the two part pole bracket comprising:

- a first part having an elongate body, said body having a tubular upper section and a tubular lower section defining a first axis, said upper section being configured to hold said pole;
- a lip extending outwardly from said tubular body said lip having a lower edge lying in a plane substantially perpendicular to said first axis;
- a second part having an attachment flange for attaching to a support surface, said attachment flange having fastener receiving openings and a cylindrical hollow sleeve sized to receive at least a portion of said lower section of said first part below said lower edge, wherein said lip rests on a top edge of said sleeve; and
- a disengageable rotational interlocking means located between said first part and said second part to prevent rotation therebetween when said first and said second parts are rotationally interlocked.

In accordance with another aspect of the present invention the above pole bracket is provided in kit form, said kit comprising said first part and said second part. Conveniently, the kit may also comprise instructions in written and/or pictorial describing the assembly and/or use of said bracket. Furthermore, the kit may also comprise at least one fastener for securing the bracket to a support surface.

In accordance with yet another aspect of the present invention there is provided a use of the above two-part pole bracket to hold a light pole, a flag pole, or an umbrella pole.

In accordance with yet another aspect of the present invention there is provided a method of using the above pole bracket comprising the steps of:

attaching said second part of said bracket to said support surface on a boat, a dock, a deck, a land vehicle, a building, or a natural or man-made projection from the ground;

inserting said pole in said upper section of said first part of said bracket;

inserting said lower section of said first part of said bracket into said sleeve of said second part; and rotationally interlocking said first and said second parts with said disengageable interlocking means.

In accordance with yet another aspect of the present invention there is provided a bracket for holding an umbrella, said umbrella having an umbrella pole, said bracket comprising:

a first part having two sections, with a lip located therebetween, one section being sized and shaped to receive and selectively retain said umbrella pole therein, the other section being a cylindrical shaft, said two sections being at an angle with respect to one another; and a second part having a cylindrical hollow sleeve sized to receive said cylindrical shaft, said sleeve having a top edge for supporting said first part by said lip, said bracket being mountable to a support surface;

one of said first part and said second part having at least one detent recess and the other of said first part and said second part having at least one complementary detent key for selectively engaging said at least one detent recess, to prevent a rotation of said cylindrical shaft within said sleeve, wherein said selective engagement of said at least one detent recess with said at least one detent key is maintainable by a weight of said first part and/or a weight of said umbrella urging said shaft of said first part into said sleeve.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein. In the figures, like elements are given like reference numbers. For the purposes of clarity, not every component is labelled in every figure, nor is every component of each embodiment of the invention shown where illustration is not necessary to allow those of ordinary skill in the art to understand the invention. Orientative words such as "top", "bottom", "front", "upper", "lower", and "side" as used herein are used for clarity with reference to the orientation of elements in the figures and are not intended to be limiting.

Figure 1:
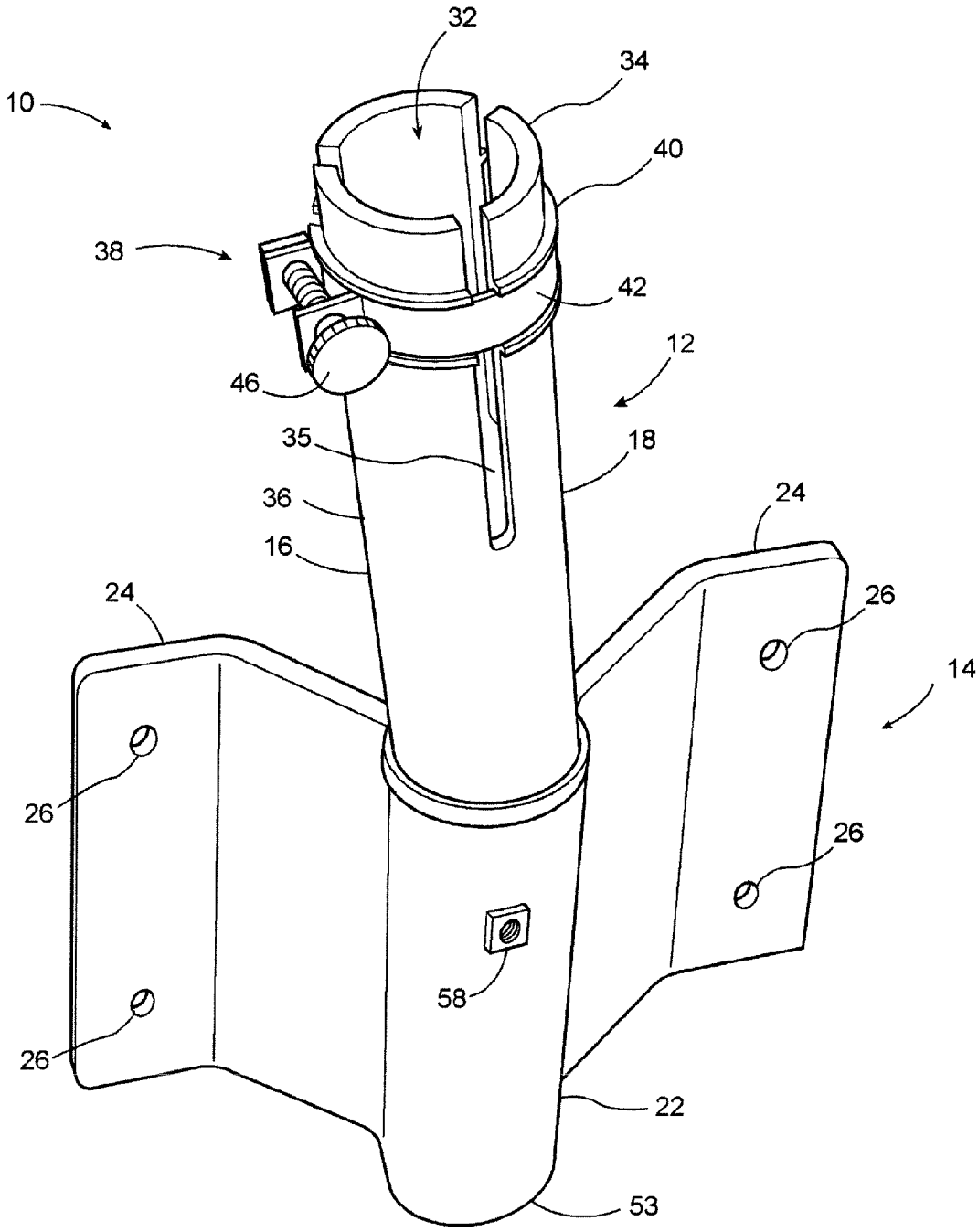
FIG. 1 is a perspective front view of a two-part pole bracket according to an embodiment of the present invention, wherein a lower section of a first part is received by a cylindrical hollow sleeve of a second part, the first part having a C-clamp comprising a screw means for tightening the C-clamp, and the second part having a threaded bolt.

An assembled two-part pole bracket 10 according to the present invention is disclosed in FIG. 1. The bracket 10 is preferably used for holding and attaching a pole 8, such as an umbrella pole, a light pole, a flag pole, or the like, to a support surface as discussed in more detail below.

The bracket 10 has two parts 12, 14 which assemble together to form the two-part bracket 10. The first part 12 has a body 16 with an upper section 18 configured to releasably hold an end of the pole 8 and a cylindrical lower section 20. A lip 21 extends outwardly from the body 16 continuously or discontinuously about the full or partial circumference of the body 16 between the upper section 18 and the lower section 20. The lip 21 has a lower edge 19 lying in a plane substantially perpendicular to an axis B defined by the lower section 20. The second part 14 has a cylindrical hollow sleeve 22, which is sized and shaped to receive at least a portion of the lower section 20 of the first part 12 below the lower edge 19 of the lip 21, and one or more attachment flanges 24 configured to attach the second part 14 to a support surface. When assembled the lower edge 19 of the lip 21 rests on a top edge 23 of the cylindrical hollow sleeve 22.

Figure 2:
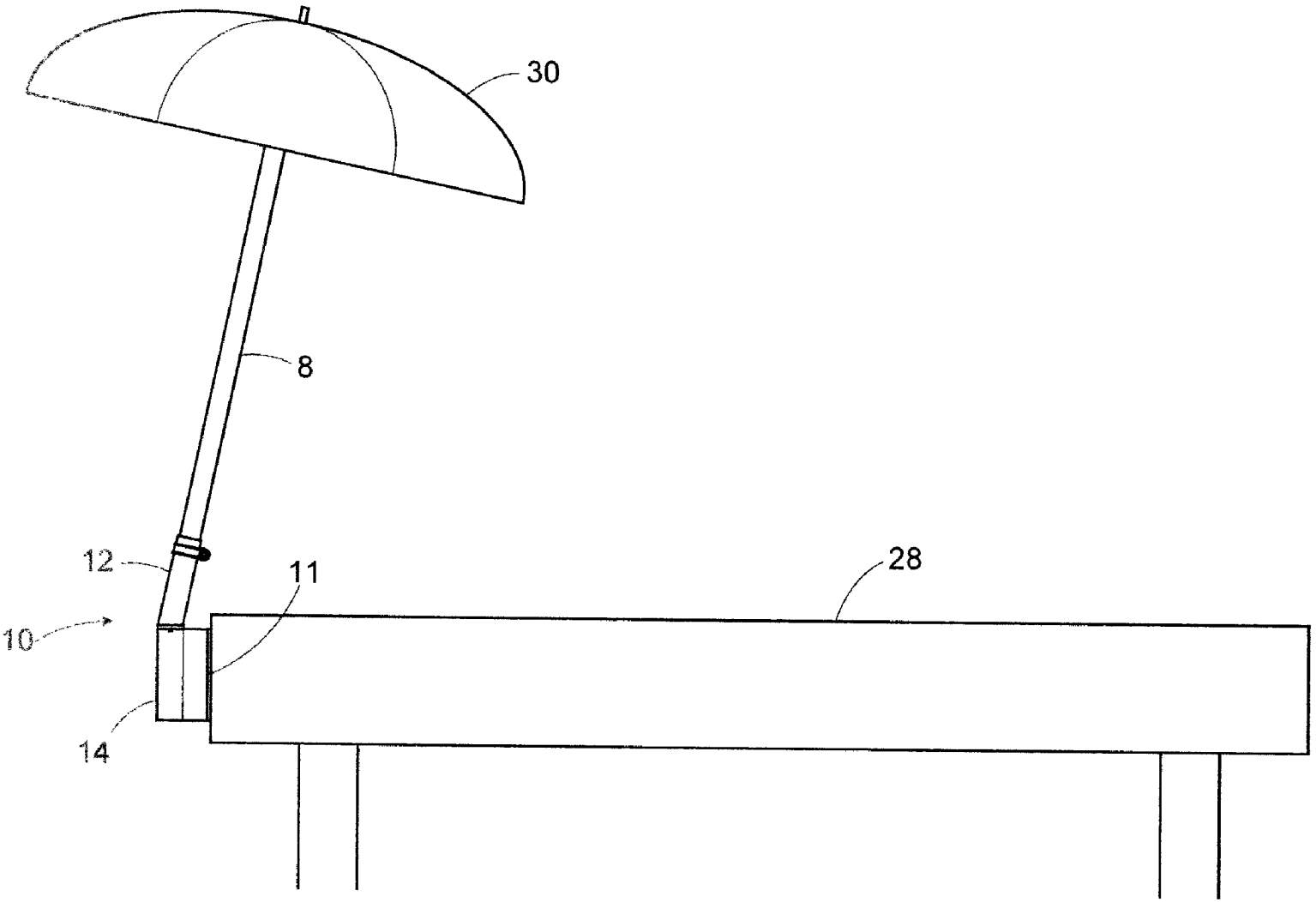
FIG. 2 is a side view of the bracket of FIG. 1 shown in use attached to a support surface and holding a pole attached to a sun umbrella.

FIG. 2 shows the two-part bracket 10 attached to a support surface 11 on a deck 28 via the attachment flange 24 with the end of the pole 8 of a sun umbrella 30 held in the upper section 18 of the first part 12. However, it will be understood that the bracket 10 may be attached to a variety of other support surfaces, including support surfaces on a boat, a dock, a land vehicle, a building, a natural or man-made projection from the ground, and the like.

The simple two part construction of the bracket 10 permits a user to easily secure the pole 8 to, and remove it from, the upper section 18, even when long poles and/or poles attached to bulky or heavy articles 30 are used. Moreover, the two part construction permits the user to easily assemble the bracket by simply inserting a cylindrical lower section 20 of the first part 12 into the cylindrical hollow sleeve 22 of the second part 14.

Providing a bend in the body 16 of the first part 12 located between the upper and lower sections 18, 20 according to one embodiment of the present invention permits the two-part bracket 10 to be configured to hold the pole 8 at an angle relative to the vertical. When such a configuration is used with a sun umbrella, for example, the user is able selectively rotate the pole 8 to constantly keep the umbrella facing the sun to provide optimal shading as the sun moves through the sky during the day.

Having generally described the structure and use of the two-part bracket 10 according to the present invention, the bracket 10 will now be described in greater detail.

Figure 3:
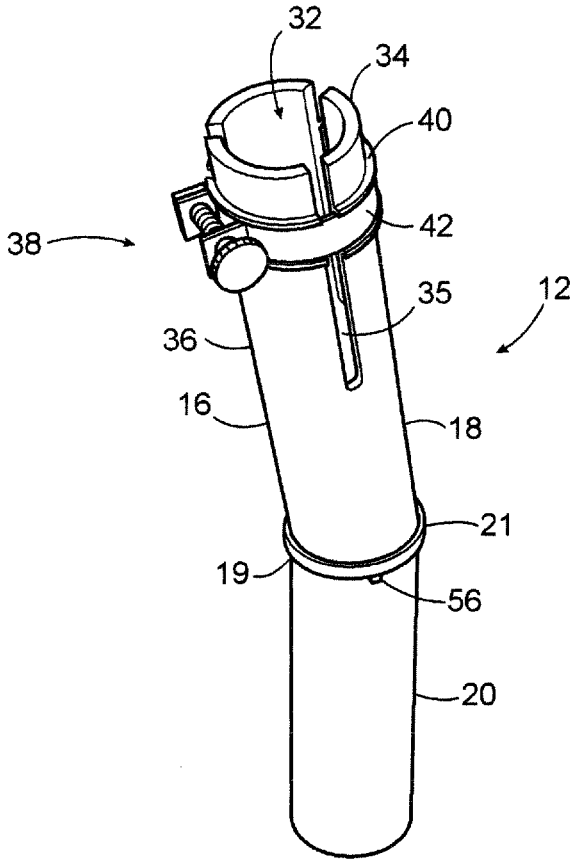
FIG. 3 is a perspective side view of a first part of the bracket of FIG. 1.

Referring now to FIG. 3, the first part, 12 from FIG. 1 is shown independent of the second part 14. The body 16 of the first part 12 is preferably a substantially hollow unitary tubular form, made by injection molding, casting, forging, mechanical forming or other methods well known in the art. The body 16 may also be formed by joining at least two tubular members together by adhering, welding, fastening or other known methods. Accordingly, the body 16 may be made from any suitable material, including metal, plastic, composite materials, wood, and combinations thereof. A preferred material is nylon.

The upper section 18 of the body 16 is sized and shaped to receive and selectively retain the end of the pole 8 therein. Preferably the upper section 18 will be configured to accommodate pole ends of various diameters within a predetermined range. Thus the upper section 18 is preferably configured to accommodate a maximum pole end diameter, and at least one pole end diameter less than the maximum pole end diameter. The preferred range of pole end diameters retainable within the upper section 18 will be determined based on the typical range of standard pole end diameters that are intended to be used with the bracket 10.

Figure 4:
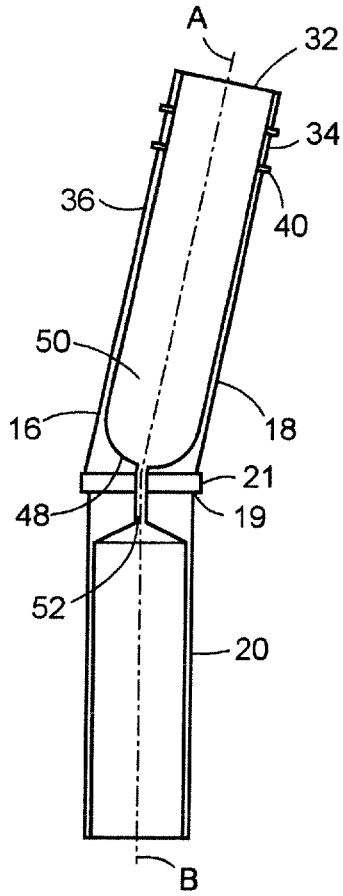
FIG. 4 is a cross-sectional side view of the first part of FIG. 3 without the C-clamp and screw means for clarity, showing a substantially hollow interior with solid lines and axis of an upper and lower section of the first part with broken lines.

According to one embodiment of the present invention, the body 16 of the first part 14 has a bend located between the upper section 18 and the lower section 20 to permit the two-part bracket 10 to be configured to hold the pole 8 at an angle relative to the vertical. When such a configuration is used with a sun umbrella, for example, the user is able selectively rotate the first part relative to the second part to constantly keep the sun umbrella facing the sun to provide optimal shading as the sun moves through the sky during the day. With reference to FIG. 4, it can be seen that the upper section 18 defines a first axis A and the lower section defines a second axis B, and that the first axis A is at an angle $\propto$ to the second axis B, so that when the first part 12 is assembled with the second part 14 the resulting two-part bracket will hold the pole 8 at an angle relative to vertical. The preferred angle $\propto$ of the bend is between about 100° and 179°. More preferredly the angle $\propto$ of the bend is between about 179° and 135°. Good results have been obtained with the angle $\propto$ of the bend being about 170°, so that when in use, the pole 8 will be held at an angle of 10° from the vertical.

However, it will be appreciated that in other embodiments of the present invention the bend may be omitted from the body 16, in which case the body 16 will be substantially straight. If the bend is desired it may be formed by molding the tubular body 16 with the bend, physically bending a straight tubular body 16, or joining at least two tubular members at an angle to one another by welding, adhering, fastening or other methods known in the art.

FIG. 3 also shows an example of a pole securing mechanism located in the upper section 18 for releasably securing the end of the pole 8 within the upper section 18. The pole securing mechanism includes an opening 32 in the upper section 18 for receiving the end of the pole 8 into a cylindrical collar 36 comprising three resiliently biasable fingers 34. The resiliently biasable fingers 34 are spaced apart by slits 35. A C-clamp 38 is positioned about a circumference of the resiliently biasable fingers 34. The C-clamp 38 is preferably retained in position by a retaining feature, which may include one or more ridges 40 projecting outwardly from one or more fingers 34, or one or more grooves (not shown) in one or more of the fingers 34, oriented about the circumference of the resiliently biasable fingers 34. The retaining feature may also be adhesive, or a weld. The weld may be metal to metal, plastic to metal, metal to plastic or plastic to plastic. What is important is that if included, the retaining feature retains the C-clamp 38 in position about the circumference of the resiliently biasable fingers 34.

Figure 5:
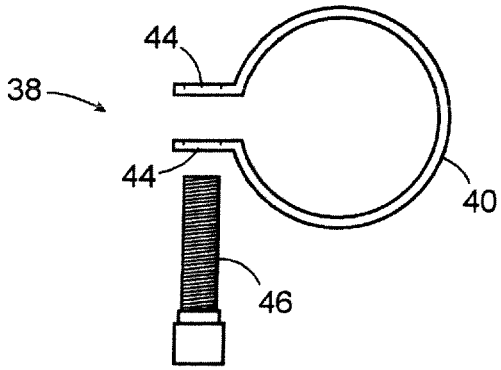
FIG. 5 is a top view of the C-clamp and screw means of FIG. 3 prior to the screw means being tightened in the C-clamp.

As best seen in FIG. 5, the C-clamp 38 has a ring shaped body 42 with apertures 44 at its ends for receiving a screw means such as a bolt 46 which when tightened will reduce the diameter of the ring shaped body 42 of the C-clamp 38. Alternately, the C-clamp may comprise a lever means (not shown) in place of the screw means to accomplish the tightening. Thus, it will be appreciated from FIG. 3, that tightening of the C-clamp 38 with the bolt 46 will urge the resiliently biasable fingers 34 towards one another, thereby reducing the diameter of the opening 32, and that loosening the C-clamp 38 will have the opposite effect. When the end of the pole 8 is inserted into the cylindrical collar 36 of the upper section 18 through the opening 32, tightening of the C-clamp 38 will result in the resiliently biasable fingers 34 moving toward one another until they grip the pole 8.

While the embodiment shown in FIG. 3 provides three resiliently biasable fingers 34, it will be understood that other embodiments may include fewer or more fingers 34. Furthermore, the upper section 18 may be provided with one slit 35 to form one resiliently biasable finger 34 capable of being deformed by the C-clamp 38 to provide the opening 32 with a reduced diameter.

However, many other pole securing mechanisms will come to the minds of those skilled in the art, including those which do not involve resiliently biasable fingers 34 or C-clamps 38. All such pole securing mechanisms are intended to be covered by the present invention. What is important is that the upper section 18 be configured to hold the pole 8.

As best seen in FIG. 4, the upper section 18 of the body 16 of the bracket 10 preferably also includes a stop means 48 in an interior portion 50 of the upper section 18. The stop means 48 is sized and shaped to support the end of the pole 8 to prevent it from sliding below a certain point in the cylindrical collar 36 of the upper section 18. Although it is contemplated that the stop means 48 may be omitted in some embodiments of the invention, if the stop means 48 is provided, it may comprise a projection extending from the interior portion 50 of the upper section 18 or a wall member, for abutting against the end of the pole 8. However, in a preferred embodiment of the present invention the stop means 48 is sized and shaped to additionally help stabilize the pole 8 within the upper section 18 when the end of the pole 8 has a diameter less than the maximum pole end diameter retainable in the upper section 18. Preferably, the stop means 48 is provided as a gradually narrowing portion in the interior portion 50 of the upper section 18. More preferrably the gradually narrowing section 48 is concave or conical shaped as best seen in FIG. 4. To help stabilize the pole 8 in the upper section 18, what is important is that the stop means 48 is sized and shaped to permit pole ends with at least two different diameters to seat against the stop means 48 to help prevent the pole 8 from wobbling within the upper section 18. Good results have been obtained by providing the stop means 48 with a gradually narrowing portion, and in particular a concave or conical shaped gradually narrowing portion.

Figure 13:
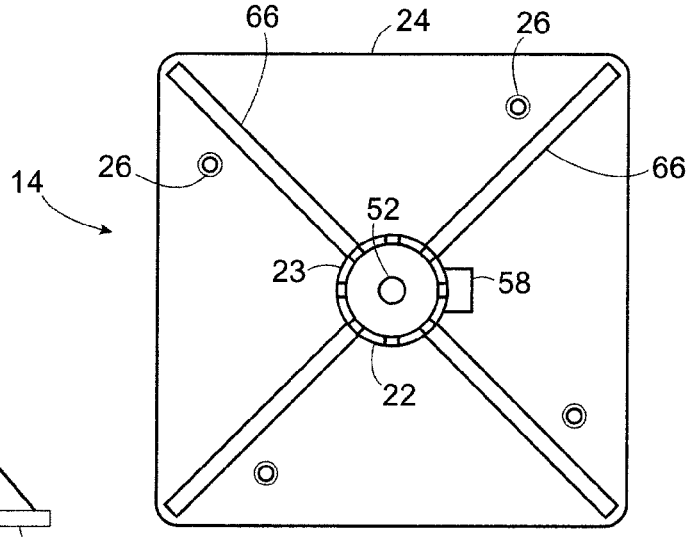
FIG. 13 is a top view of the second part of FIG. 12.

Preferably the upper section 18 is configured to permit water entering the cylindrical collar 36 of the upper section 18 to drain out from the cylindrical collar 36. Accordingly, some embodiments of the present invention may call for a drain hole 52 being provided either in the upper section 18 to permit the water to drain out directly, or in the stop means 48 to permit the water to drain out indirectly through the lower section 20. As shown in FIG. 13, If the bottom 53 of the cylindrical sleeve 22 of the second part 14 is blocked, a drain hole 52 may also be provided therein to permit water entering the cylindrical hollow sleeve 22 to drain out of the second part 14.

Figure 6:
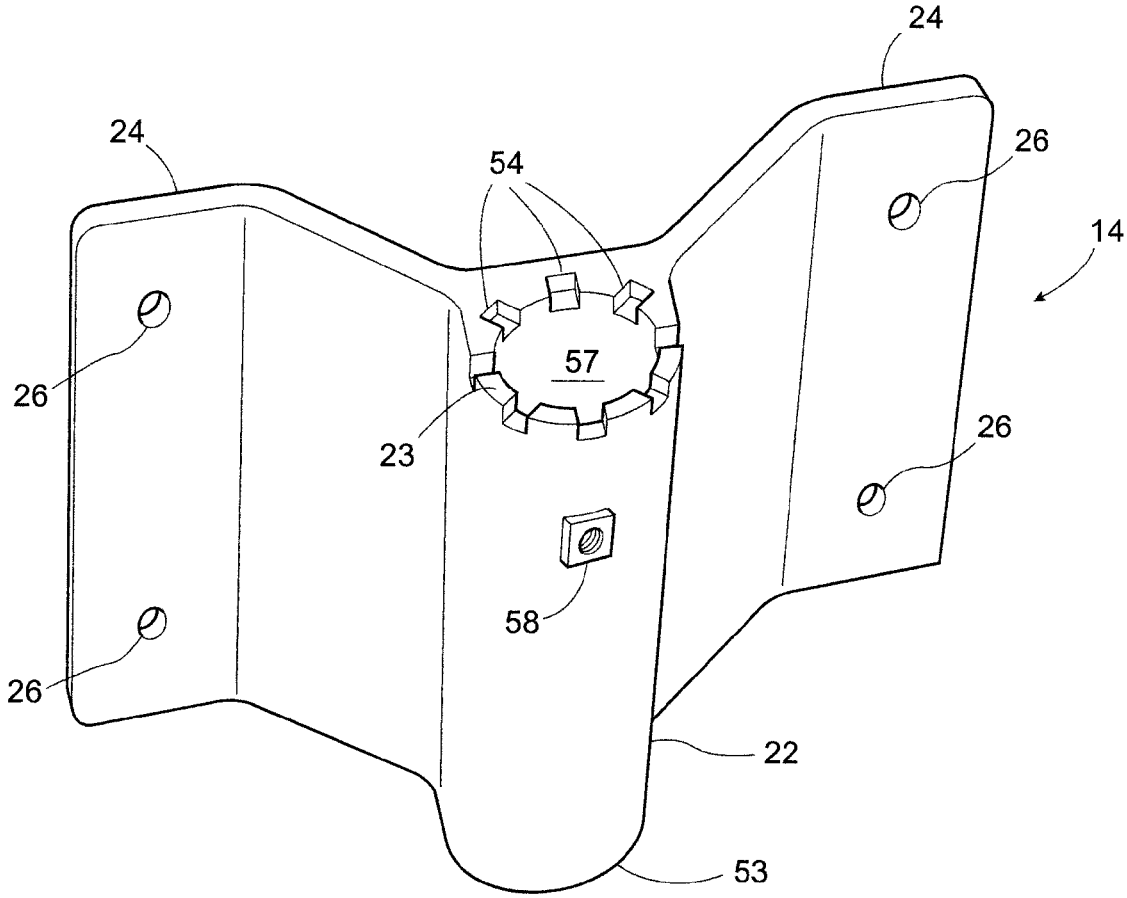
FIG. 6 is a perspective front view of the second part of FIG. 1.

Referring now to FIG. 6, the second part 12 from FIG. 1 is shown independent of the first part 12 to more clearly show a top edge 54 of the cylindrical hollow sleeve 22. Attached to the hollow sleeve 22 is the attachment flange 24 for attaching to the support surface 11. The attachment flange 24 is shown with four fastener receiving openings 26. However, it will be understood that more or fewer fastener receiving openings 26 may be provided according to requirements. It will also be understood that the attachment flange 24 may take various shapes and forms. What is important is that the attachment flange 24 is attachable to the support surface 11.

The top edge 23 of the cylindrical hollow sleeve 22 includes at least one detent recess 54, while the body 16 of the first part 12 has at least one complementary detent key 56 depending from the lip 21 as best seen in FIG. 3. In the embodiment of the invention shown in FIG. 6 the detent recesses 54 are provided in the top edge 23 along an inner surface 57 of the cylindrical hollow sleeve 22 so that they may be covered by the first part 12 and thus hidden from view.

As will now be understood, the detent recess 54 in the top edge 23 of the second part 14 and complementary detent key 56 on the lip 21 of the first part 12 are an example of a disengageable rotational interlocking means which serves to prevent rotation of the first part 12 relative to the second part 14 when the first and second parts 12, 14 are rotationally interlocked. Accordingly, when the first and second parts 12, 14 are not rotationally interlocked the first part 12 is rotatable within the cylindrical hollow sleeve 22 of the second part 14. The disengageable rotational interlocking means may be alternately configured to provide the detent recess 54 in the lip 21 of the first part 12 and the complementary detent key 56 on the top edge of the cylindrical sleeve 22. Furthermore, the disengageable rotational interlocking means may include a plurality of detent recesses 54 and detent keys 56, which may be distributed between the lip 21 and the top edge 23. It is also contemplated that the detent keys 54 and detent recesses may be variously sized and shaped, so long as they are operationally complementary. What is important is that the disengageable rotational interlocking means is located between the first part 12 and the second part 14 to prevent rotation therebetween when the first and second parts are rotationally interlocked.

It will now be appreciated that the user may lift the first part 12 from the second part 14 to disengage the rotational interlock, rotate the first part 12 relative to the second part 14 and lower the first part 12 onto the second part 14 to re-engage the rotational interlock. This permits the user to easily rotate and interlock the first part 12 and second part 14 in selected positions relative to one another. The rotational interlock may generally be maintained by a weight of the first part 12 and/or a weight of the pole 8 and article 30 attached thereto urging the lower section 20 of the first part 12 into the cylindrical sleeve 22 of the second part 14.

Figure 7:
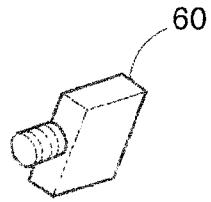
FIG. 7 is a perspective view of the threaded bolt of FIG. 1.

Additionally, as best seen in FIGS. 1 and 6, to help maintain the rotational interlock between the first part 12 and the second part 14, the second part 14 may be provided with a passageway 58, at least a portion of which is threaded, for selectively receiving a threaded bolt 60 (see FIG. 7) which can be tightened to impinge on the lower section 20 when in the cylindrical hollow sleeve 22, to make it more difficult to lift the first part 12 from the second part 14 and dis-engage the rotational interlock.

The second part 14 may be made by injection molding, casting, or forging, mechanical forming or other methods well known in the art. Accordingly, the second part 12 may be made with any suitable material, including metal, plastic, composite materials, wood or combinations thereof. A preferred material is nylon.

Figure 8:
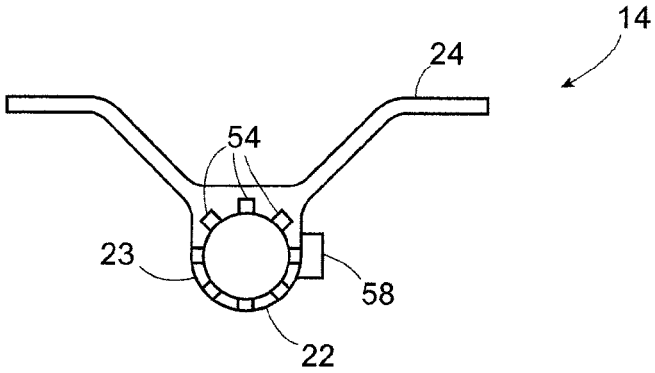
FIG. 8 is a top view of the second part of FIG. 6 according to another embodiment of the present invention.
Figure 9:
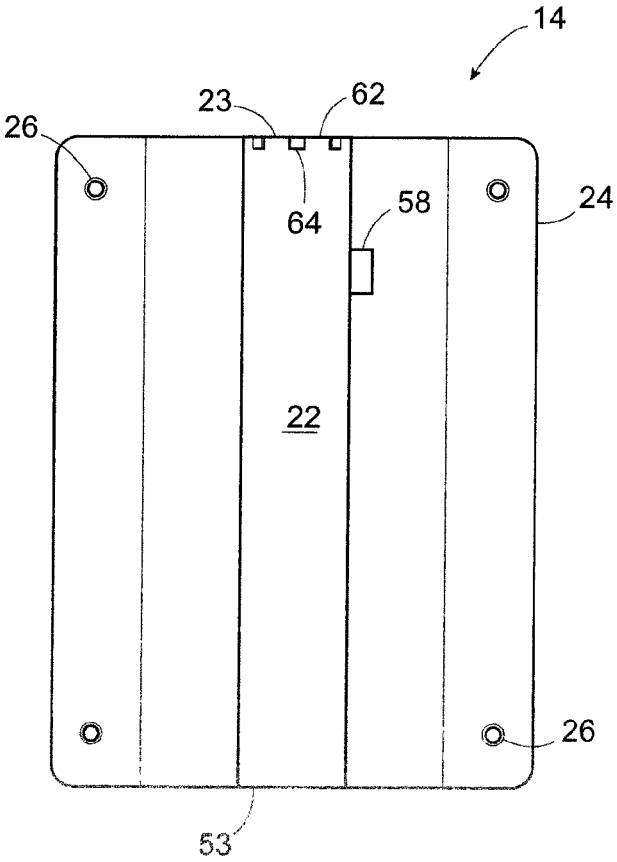
FIG. 9 is a front view of the second part of FIG. 8.
Figure 10:
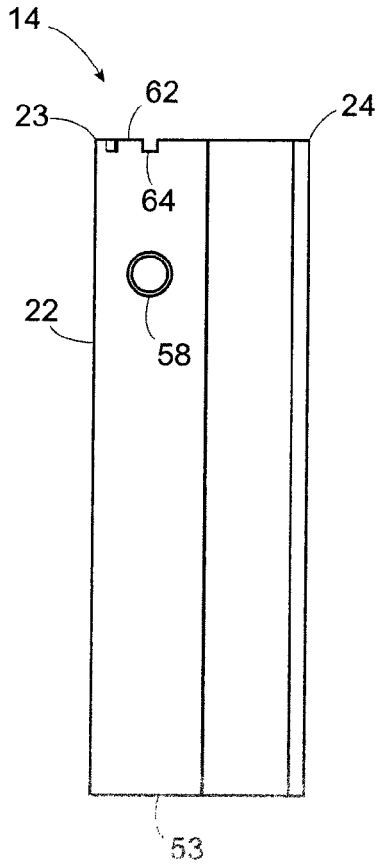
FIG. 10 is a side view of the second part of FIG. 9.
Figure 11:
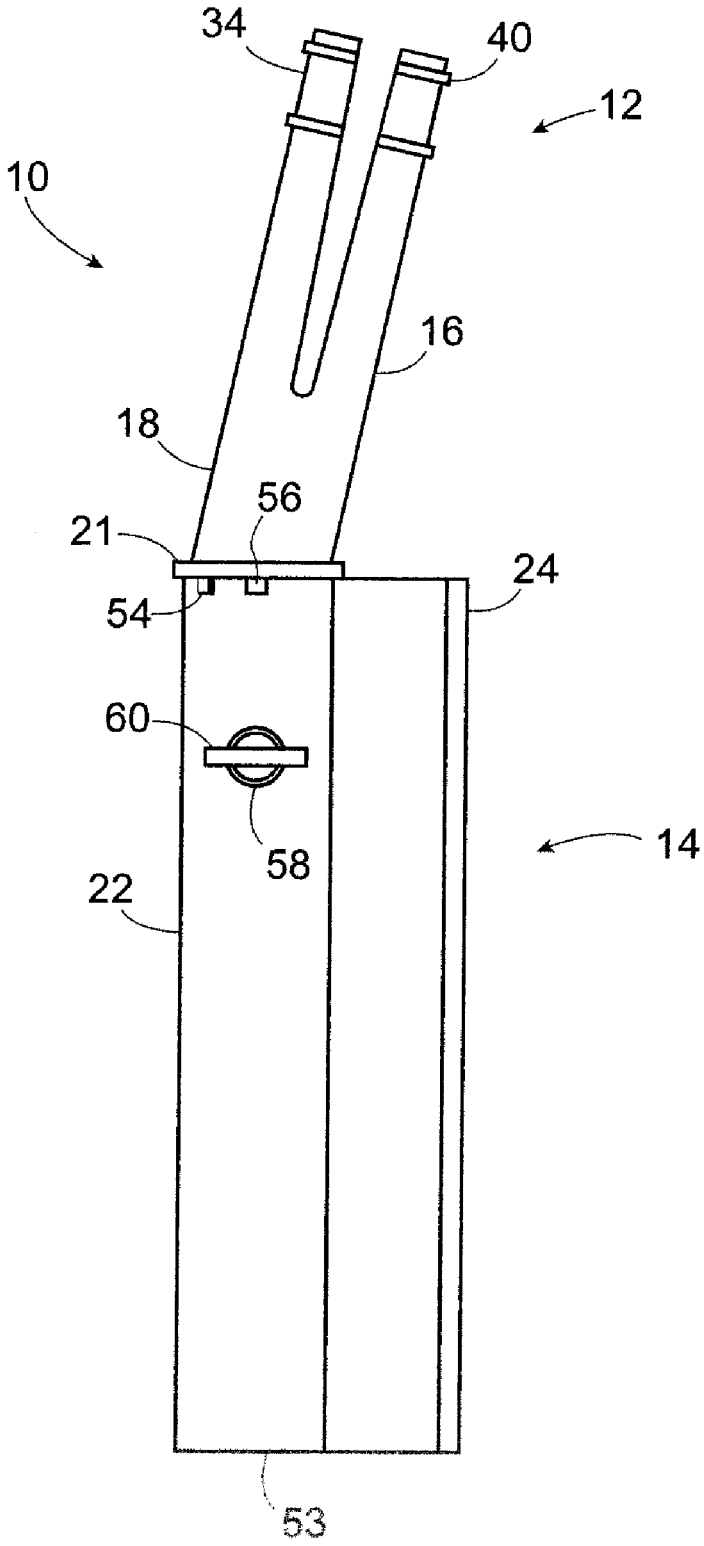
FIG. 11 is a side view of the two-part pole bracket according to another embodiment of the present invention, the bracket being shown assembled with the first part of FIG. 1 and the second part of FIG. 8.

FIGS. 8 to 10 show top, front and side views of an alternate embodiment of the second part 14 in which the top edge 23 has detent recesses 54 having a castled appearance with alternating raised and lowered portions 62, 64. The attachment flange 24 is oriented in a plane which is parallel to an axis of the cylindrical sleeve 22, so that when the attachment flange 24 is attached to the support surface 11, the cylindrical sleeve 22 will be aligned parallel with the support surface 11. Furthermore, the passageway 58 is preferably positioned parallel with the attachment flange 24 to prevent potentially snagging persons passing by the bracket 10. FIG. 11 shows a side view of the assembled bracket 10 with the first part 12 of FIG. 3 rotationally interlocked with the second part 14 of FIGS. 8 to 10 in a user selected position. The rotational interlock is further maintained with the threaded bolt 60 of FIG. 7 in passageway 58.

Figure 12:
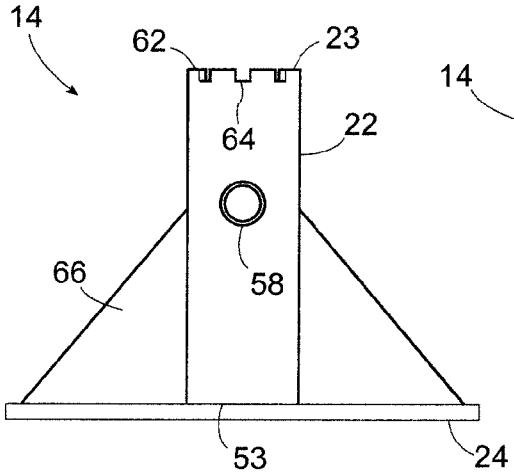
FIG. 12 is a front view of the second part according to another embodiment of the present invention.
Figure 14:
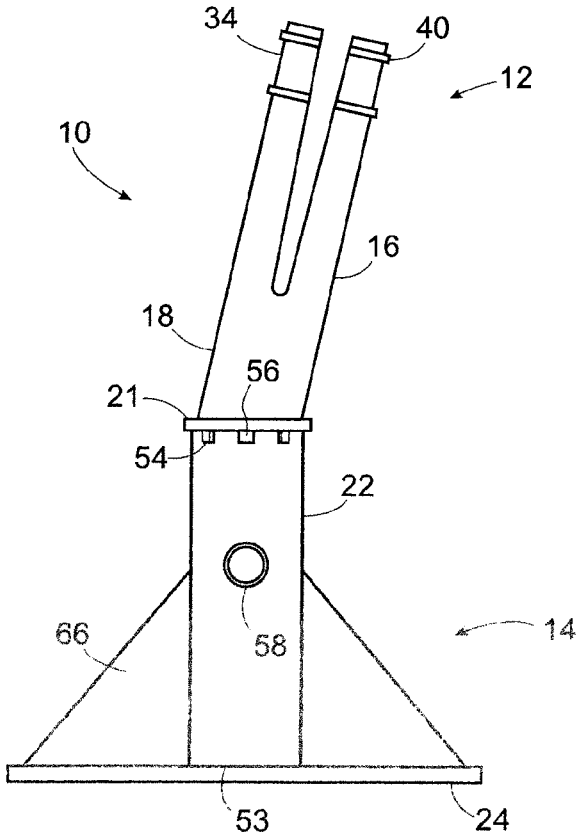
FIG. 14 is a front view of the two part pole bracket according to another embodiment of the present invention, the bracket being shown assembled with the first part of FIG. 1 and the second part of FIG. 13.

FIGS. 12 and 13 show front and side views of an alternate embodiment of the second part 14 in which the top edge 23 has detent recesses 54 having a castled appearance with alternating raised and lowered portions 62, 64. However, the attachment flange 24 is oriented in a plane which is perpendicular to the axis of the cylindrical sleeve 22, so that when the attachment flange 24 is attached to the support surface 11, the cylindrical sleeve 22 will be aligned perpendicular with the support surface 11. Furthermore, the second part 14 includes four web members 66 connecting between the cylindrical sleeve 22 and the attachment flange 24 to reinforce the second part 14. As best seen in FIG. 13, the drainage hole 52 is provided in the bottom 53 of the cylindrical sleeve 22 to permit water entering the cylindrical sleeve 22 to drain away, since in this embodiment the bottom 53 is otherwise covered by the attachment flange 24. FIG. 14 shows a side view of the assembled bracket 10 with the first part 12 of FIG. 3 rotationally interlocked with the second part 14 of FIGS. 12 and 13 in a user selected position. The rotational interlock is further maintained with the threaded bolt 60 of FIG. 7 in passageway 58.

Figure 15:
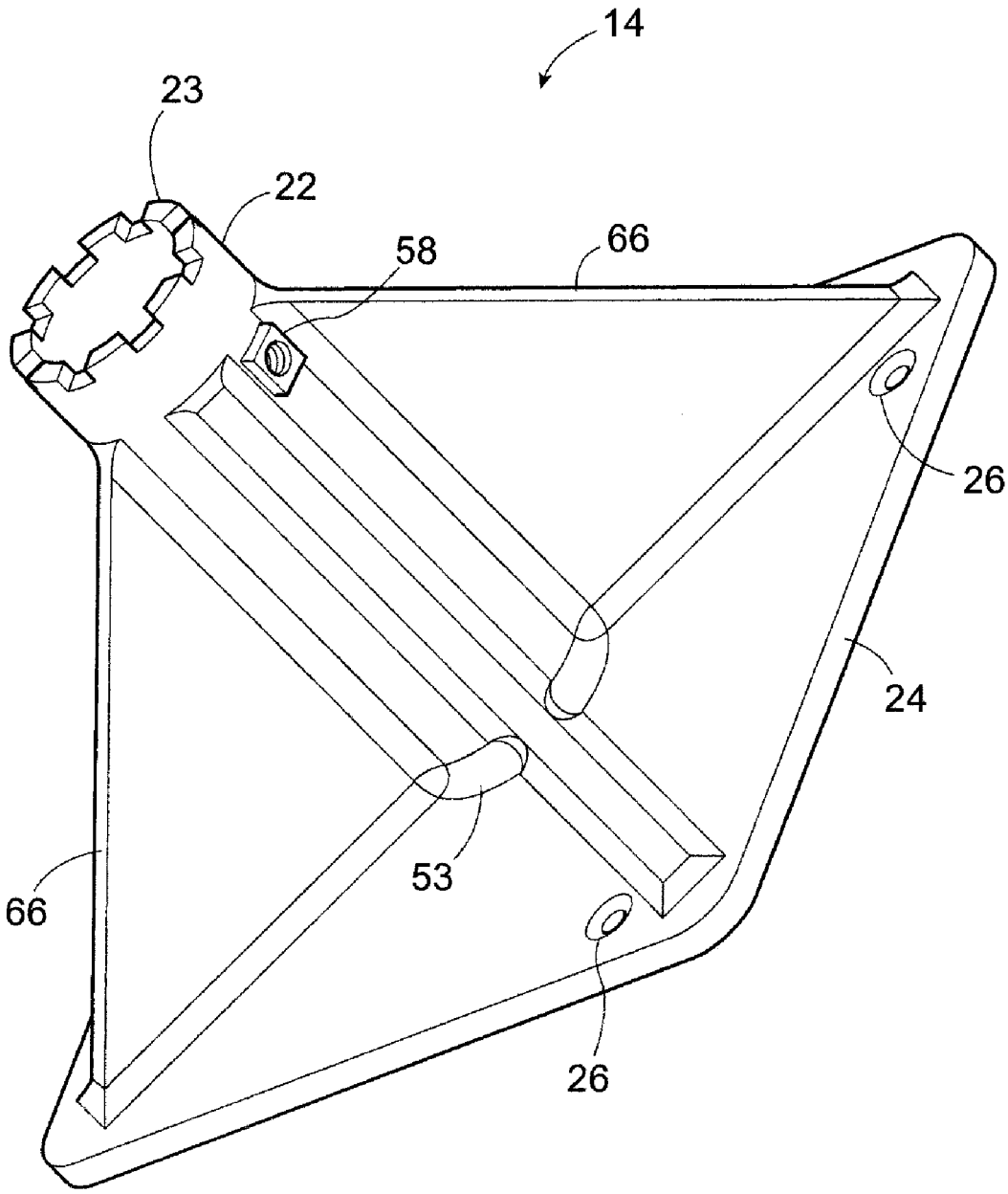
FIG. 15 is a perspective view of the second part according to another embodiment of the present invention.

FIG. 15 shows a perspective view of an alternate embodiment of the second part 14, similar to the second part of FIGS. 12 and 13, but in the detent recesses 54 are provided in the top edge 23 along the inner surface 57 of the cylindrical sleeve 22 as in FIG. 6, so that they will be covered by the first part 12 and thus hidden from view.

Figure 16:
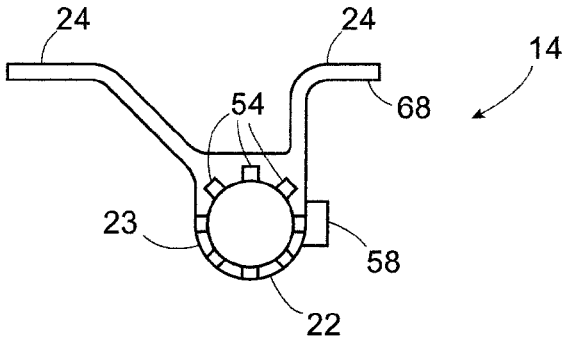
FIG. 16 is a top view of the second part according to another embodiment of the present invention.
Figure 17:
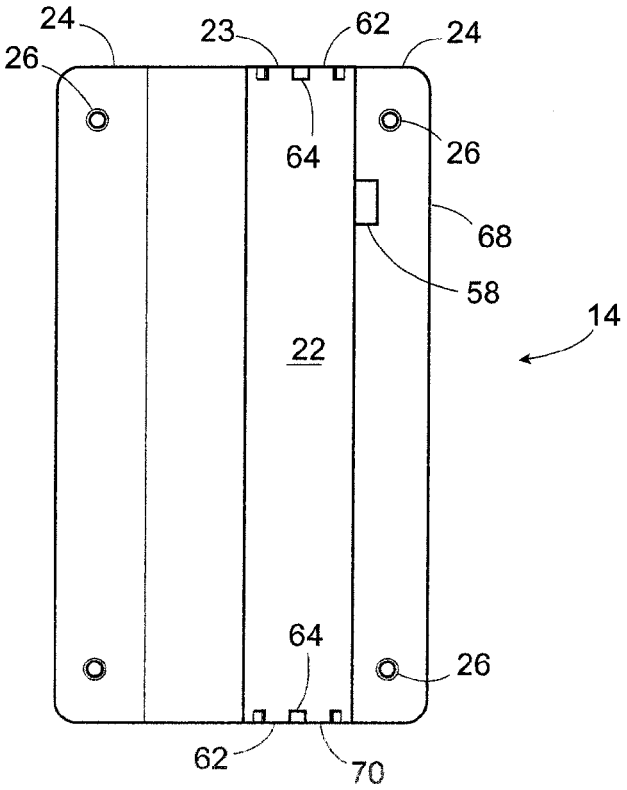
FIG. 17 is a front view of the second part of FIG. 16.
Figure 18:
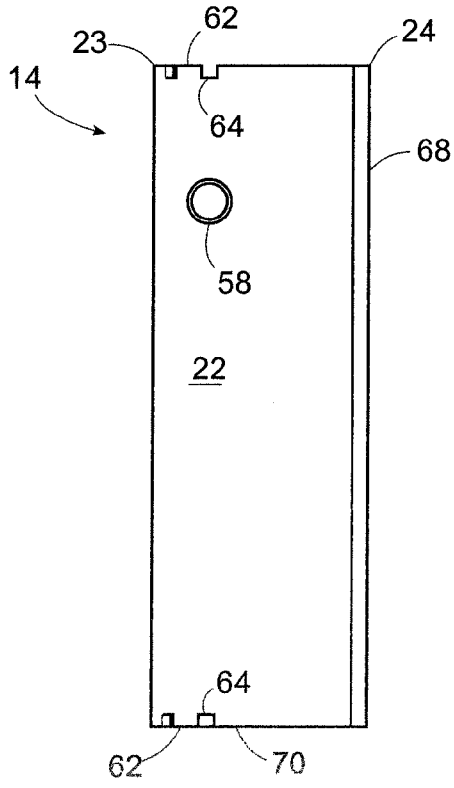
FIG. 18 is a side view of the second part of FIG. 17.

FIGS. 16 to 18 show top, front, and side views of a further embodiment of the second part 14 for use with a support surface 11 adjacent to a corner. As can be seen, the attachment flange 24 is provided with a shorter profile on the corner facing side 68 to permit the cylindrical sleeve to be positioned closer to the corner. Furthermore, detent recesses 54 are provided both in the top edge 23 and bottom edge 70 of the cylindrical hollow sleeve 22 to permit the second part 14 to be used in left or right corners by simply rotating the second part 14 to position the corner facing side 68 on the left or right as required.

The two-part bracket may be provided in the form of a kit containing one or more first parts and one or more second parts. It is contemplated that first parts with bends of varying angles and/or pole securing mechanisms may be provided and usable interchangeably with the same second part. The kit may further include instructions in written and/or pictorial form for assembly and/or use of the bracket 10. The kit may further include one or more fasteners for the fastener receiving openings 26 on the attachment flange 26.

In use, the second part 14 of the two-part bracket 10 is preferably attached to the support surface 11 via the attachment flange 24 with fasteners through the fastener receiving openings 26. The support surface 11 may be on a boat, dock, deck, land vehicle, building, or natural or man-made projection from the ground. The end of the pole 8 is inserted in the upper section 18 of the first part 12 of the bracket 10 and secured therein. The lower section 20 of the first part 12 is then inserted into the cylindrical sleeve 22 of the second part 14. The first part 12 and second part 14 are rotationally interlocked with the disengageable interlocking means to prevent rotation between the first part 12 and the second part 14.

By way of example, the two-part bracket 10 may be attached to a boat, and used with a sun umbrella to provide shade while pleasure boating at low speeds or fishing. As another example, the two-part bracket 10 may be attached to a tree or tree stump, and used with a camouflaged umbrella to provide shelter and/or to conceal a hunter while hunting. Alternately, in place of the camouflaged umbrella, another canopy structure can be held by the two-part bracket 10, provided that the canopy structure has a pole which fits in the upper section 18 of the first part 12 of the body 16 of the two-part bracket 10.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention and intended to be covered by the appended claims, without limitation.

I claim:

1. A two part bracket for holding a pole, the two part pole bracket comprising:

a first part having an elongate body, said body having a tubular upper section and a tubular lower section defining a first axis, said upper section being configured to hold said pole;

a lip extending outwardly from said tubular body said lip having a lower edge lying in a plane substantially perpendicular to said first axis;

a second part having an attachment flange for attaching to a support surface and a cylindrical hollow sleeve sized to receive at least a portion of said lower section of said first part below said lower edge, wherein said lip rests on a top edge of said sleeve; and a disengageable rotational interlocking means located between said first part and said second part to prevent rotation therebetween when said first and said second parts are rotationally interlocked.

2. The bracket as claimed in claim 1, wherein said pole is a light pole, a flag pole, or an umbrella pole.

3. The bracket as claimed in claim 1, wherein said support surface is on a boat, a dock, a deck, a land vehicle, a building, or a natural or man-made projection from the ground.

4. The two part bracket of claim 1, wherein said body has a bend located between said upper and lower sections, the upper section defining a second axis, said first axis being at an angle to said second axis, whereby said two part bracket is configured to hold said pole at an angle relative to vertical.

5. The bracket as claimed in claim 4, wherein said angle of said first axis to said second axis is between about 100° and 179°.

6. The bracket as claimed in claim 5, wherein said angle of said first axis to said second axis is between about 179° and 135°.

7. The bracket as claimed in claim 6, wherein said angle of said first axis to said second axis is 170°.

8. The bracket as claimed in claim 5, wherein said bend is formed by joining at least two tubular members at an angle to one another.

9. The bracket as claimed in claim 8, wherein said joining is by welding, adhering, or fastening.

10. The bracket as claimed in claim 4, wherein said bend is formed by physically bending said body.

11. The bracket as claimed in claim 4, wherein said bend is formed by moulding said body with said bend.

12. The bracket as claimed in claim 1, wherein said body is straight.

13. The two part bracket of claim 1, wherein said upper section and/or said lower section of said body has a substantially hollow interior.

14. The bracket as claimed in claim 1, wherein said rotational interlock is maintainable by a weight of said first part and/or a weight of said pole urging said lower section of said first part into said sleeve of said second part.

15. The bracket as claimed in claim 14, wherein said hollow sleeve comprises a passageway therethrough, at least a portion of said passageway being threaded, for selectively receiving a threaded bolt to impinge on said lower section when in said hollow sleeve, to help maintain said rotational interlock between said first and second parts.

16. The bracket as claimed in claim 1, wherein said disengageable rotational interlocking means comprises at least one detent recess on one of said first part and said second part, and at least one complementary detent key on the other of said first part and said second part, for selectively engaging said at least one detent recess.

17. The bracket as claimed in claim 16, wherein one of said at least one detent recess and said at least one detent key is positioned between said lip and said top edge.

18. The bracket as claimed in claim 17, wherein one of said at least one detent recess and said at least one detent key is associated with said lip, and the other of said at least one detent recess and said at least one detent key is associated with said top edge of said sleeve.

19. The bracket as claimed in claim 18, wherein said at least one detent key projects from said lip or said top edge.

20. The bracket as claimed in claim 18, wherein said at least one detent recess is formed in said lip or said top edge.

21. The bracket as claimed in claim 17, wherein said disengageable rotational interlocking means comprises a plurality of detent recesses.

22. The bracket as claimed in claim 21, wherein said disengageable rotational interlocking means comprises fewer detent keys than detent recesses.

23. The bracket as claimed in claim 1, wherein said upper section is sized and shaped to receive and selectively retain said pole therein.

24. The bracket as claimed in claim 23, wherein said upper section comprises a pole securing mechanism for selectively securing said pole within said upper section.

25. The bracket as claimed in claim 24, wherein said pole securing mechanism has an opening defining a diameter for passing said pole therethrough, said pole securing mechanism being configured to selectively reduce said diameter of said opening from a maximum diameter retainable in said upper section to a minimum diameter retainable in said upper section.

26. The bracket as claimed in claim 25, wherein said pole securing mechanism comprises at least two resiliently biasable fingers for selectively retaining said pole in said upper section.

27. The bracket as claimed in claim 26, wherein said pole securing mechanism further comprises a C-clamp to urge said resiliently biasable fingers towards one another when said C-clamp is tightened.

28. The bracket as claimed in claim 27, wherein said C-clamp comprises a screw means to tighten said C-clamp.

29. The bracket as claimed in claim 27, wherein said pole securing mechanism further comprises a feature for retaining said C-clamp to said upper section of said first part.

30. The bracket as claimed in claim 29, wherein said C-clamp retaining feature comprises at least one ridge extending outwardly from said resiliently biasable fingers about a circumference defined by said resiliently biasable fingers.

31. The bracket as claimed in claim 29, wherein said C-clamp retaining feature comprises an adhesive.

32. The bracket as claimed in claim 29, wherein said C-clamp retaining feature comprises a weld.

33. The bracket as claimed in claim 1, wherein said interior of said upper section comprises a stop means sized and shaped to support an end of said pole.

34. The bracket as claimed in claim 33, said stop means comprises a first drain hole to permit water entering said interior of said upper section to drain out from said interior.

35. The bracket as claimed in claim 33, wherein said stop means is further sized and shaped to help stabilize said pole in said upper section when said pole has a diameter less than a maximum pole diameter retainable in said upper section.

36. The bracket as claimed in claim 35, wherein said stop means is sized and shaped to provide a gradually narrowing portion.

37. The bracket as claimed in claim 36, wherein said gradually narrowing portion is concave shaped.

38. The bracket as claimed in claim 36, wherein said gradually narrowing portion is conical shaped.

39. The bracket as claimed in claim 36, wherein said second part has a second drain hole to permit water entering said hollow sleeve to drain out of said hollow sleeve.

40. The bracket as claimed in claim 1, wherein said lip extends continuously or discontinuously about a periphery of said first part.

41. The bracket as claimed in claim 1, wherein said lip extends partially about a periphery of said first part.

42. The bracket as claimed in claim 1, wherein said sleeve defines an axis and said attachment flange lies in a second plane substantially perpendicular to said axis, so that when said attachment flange is attached to said support surface, said sleeve is perpendicular to said support surface.

43. The bracket as claimed in claim 1, wherein said sleeve defines an axis and said attachment flange lies in a second plane substantially parallel to said axis, so that when said attachment flange is attached to said support surface, said sleeve is perpendicular to said support surface.

44. The bracket as claimed in claim 1, further comprising at least one web member connecting between said sleeve and said attachment flange to reinforce said second part.

45. The bracket as claimed in claim 1, wherein said the attachment flange comprises at least one fastener receiving opening.

46. The bracket as claimed in claim 1, wherein said first part and/or said second part is made from plastic, metal, or wood.

47. The bracket as claimed in claim 1, wherein said first part and/or said second part is formed by moulding.

48. The bracket as claimed in claim 1 provided in kit form, said kit comprising:

said first part and said second part.

49. The bracket as claimed in claim 48 further comprising instructions for assembly and/or use of said bracket, said instructions being in written and/or pictorial form.

50. The bracket as claimed in claim 48 further comprising at least one fastener.

51. Use of the bracket as claimed in claim 1 to hold a light pole, a flag pole, or an umbrella pole.

52. A method of using the bracket as claimed in claim 1 comprising the steps of:

attaching said second part of said bracket to said support surface on a boat, a dock, a deck, a land vehicle, a building, or a natural or man-made projection from the ground;

inserting said pole in said upper section of said first part of said bracket;

inserting said lower section of said first part of said bracket into said sleeve of said second part; and rotationally interlocking said first and said second parts with said disengageable interlocking means.

53. A bracket for holding an umbrella, said umbrella having an umbrella pole, said bracket comprising:

a first part having two sections, with a lip located therebetween, one section being sized and shaped to receive and selectively retain said umbrella pole therein, the other section being a cylindrical shaft, said two sections being at an angle with respect to one another; and a second part having a cylindrical hollow sleeve sized to receive said cylindrical shaft, said sleeve having a top edge for supporting said first part by said lip, said bracket being mountable to a support surface;

one of said first part and said second part having at least one detent recess and the other of said first part and said second part having at least one complementary detent key for selectively engaging said at least one detent recess, to prevent a rotation of said cylindrical shaft within said sleeve, wherein said selective engagement of said at least one detent recess with said at least one detent key is maintainable by a weight of said first part and/or a weight of said umbrella urging said shaft of said first part into said sleeve.

* * * * *